United States Patent [19]

Siegle et al.

[11] 4,378,240

[45] Mar. 29, 1983

[54] PREPARATION OF ACICULAR FERROMAGNETIC METAL PARTICLES CONSISTING ESSENTIALLY OF IRON

[75] Inventors: Hansjoerg Siegle; Hans H. Reich, both of Ludwigshafen; Horst Autzen, Freinsheim; Werner Steck, Mutterstadt; Werner Loeser, Ludwigshafen; Eckhard Hetzel, Bobenheim-Roxheim; Manfred Ohlinger, Frankenthal, all of Fed. Rep. of Germany

[73] Assignee: BASF Aktiengesellschaft, Ludwigshafen, Fed. Rep. of Germany

[21] Appl. No.: 268,108

[22] Filed: May 28, 1981

[30] Foreign Application Priority Data

Jun. 4, 1980 [DE] Fed. Rep. of Germany ..... 3021111

[51] Int. Cl.[3] ..... C22B 1/10

[52] U.S. Cl. ..... 75/0.5 BA; 75/26; 148/105; 266/172; 422/143

[58] Field of Search ..... 75/0.5 BA, 26; 148/105; 422/143; 266/172

[56] References Cited

U.S. PATENT DOCUMENTS

| | | | |
|---|---|---|---|
| 2,879,154 | 3/1959 | Campbell | 75/0.5 BA |
| 2,947,620 | 8/1960 | Whitehouse et al. | 75/0.5 BA |
| 3,967,986 | 7/1976 | Rau | 75/0.5 BA |

FOREIGN PATENT DOCUMENTS

| | | |
|---|---|---|
| 1458765 | 4/1967 | Fed. Rep. of Germany . |
| 2028536 | 3/1972 | Fed. Rep. of Germany . |
| 2434058 | 7/1974 | Fed. Rep. of Germany . |
| 2434096 | 7/1974 | Fed. Rep. of Germany . |
| 2361539 | 1/1975 | Fed. Rep. of Germany . |
| 2646348 | 10/1976 | Fed. Rep. of Germany . |
| 2714588 | 4/1977 | Fed. Rep. of Germany . |
| 2743298 | 9/1978 | Fed. Rep. of Germany . |
| 1104852 | 3/1968 | United Kingdom . |

*Primary Examiner*—W. Stallard

*Attorney, Agent, or Firm*—Keil & Witherspoon

[57] ABSTRACT

A process for the preparation of acicular ferromagnetic metal particles, consisting essentially of iron, by reducing acicular iron oxides and/or iron oxide hydroxides, which are either pure or are modified with conventional foreign metal ions, by means of a gaseous reducing agent in a fluidized bed furnace in which a stirrer is provided immediately above the fluidizing grid.

3 Claims, 2 Drawing Figures

Figure 1:
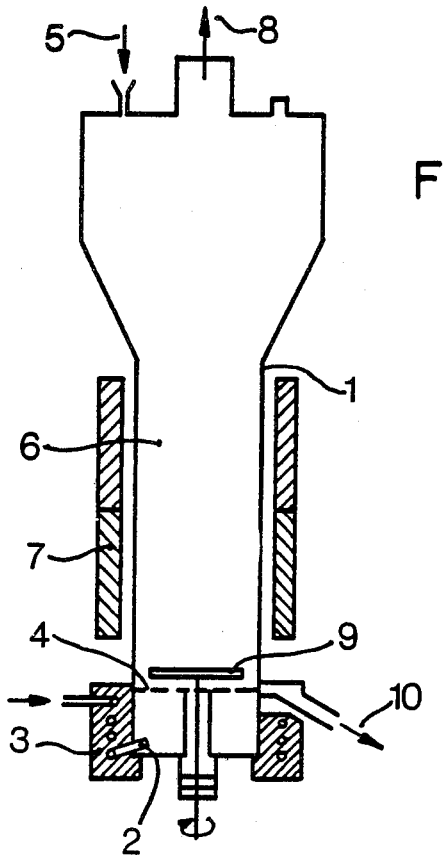

PREPARATION OF ACICULAR FERROMAGNETIC METAL PARTICLES CONSISTING ESSENTIALLY OF IRON

The present invention relates to the preparation of acicular ferromagnetic metal particles, consisting essentially of iron, by reducing acicular iron oxides or iron oxide hydroxides, which are pure or modified with conventional foreign metal ions, by means of gaseous reducing agents in a fluidized bed.

The use of acicular ferromagnetic metal particles behaving like single-domain particles as magnetizable material for the production of magnetic recording media has been known for a long time. The high coercive force and high residual magnetization achievable with such materials, as compared to those achievable with the conventionally employed ferromagnetic iron oxides, were, at an early stage, the reason for seeking ways of manufacturing these materials industrially, by a simple method, in accordance with the relevant theoretical concepts. Amongst a number of possible ways of producing appropriate metal particles, the method particularly used is the pseudomorphous conversion of pure or modified acicular iron oxides by means of a reducing gas. In such a pseudomorphous conversion, the particles of the reaction product have essentially the same shape and dimensions as those of the starting material. Since it is especially iron oxides and iron oxide hydroxides which can easily be produced, by conventional methods and under controllable conditions, in a size and acicular shape required for ferromagnetic metal particles behaving like single-domain particles, these production processes have proved particularly suitable. However, in carrying out such a reduction of oxidic material to the metal, it is necessary to ensure that the reaction temperature is, on the one hand, sufficiently high for the chemical reaction to proceed at a sufficient speed, but on the other hand not so high that the particles undergo changes in shape. Furthermore, there should be as little contact as possible between the particles, so that they do not grow together. For this reason, French Pat. No. 1,442,638 has already proposed carrying out the reduction of iron oxide hydroxide to ferromagnetic iron oxide in a fluidized bed. A fluidized bed furnace has also already been used for the more extensive reduction of the iron oxide or iron oxide hydroxide particles to corresponding iron particles by means of a gas consisting essentially of hydrogen (German Laid-Open Application DOS 2,028,536). In such a fluidized bed furnace, the individual particles of the material to be reduced are kept suspended, due to dynamic buoyancy, by means of a stream of gas which rises upwards in a vertical cylindrical tube. A loose mass of powder is thus converted, in such a column, into a fluid-like state, which permits particularly intensive energy transfer and mass transfer between the reactants. The same arrangement can also be used advantageously for passivating the iron particles, which because of their small size are pyrophoric (cf., inter alia, Knauff, Neue magnetische Materialien für Tonbänder, in Philips: Unsere Forschung in Deutschland, Volume 2 (1972), page 125 et seq.).

Fluidized bed furnaces, which can be used in diverse ways for different reactions, are known in a plurality of embodiments. For example, German Pat. No. 1,458,765 describes a multi-stage fluidized bed reactor for the reduction of iron oxides, whilst U.S. Pat. No. 3,967,986 states that the use of a powder drying furnace having a plurality of rotatable porous members, as described in British Pat. No. 1,104,852, is particularly advantageous for the reduction of iron oxide and/or iron oxide hydroxide powder to ferromagnetic material for magnetic recording media. Though the product obtained has good properties, it is a disadvantage that in such a modified fluidized bed furnace the powder layer present on the porous members is only about 2 mm thick, so that the elaborate process gives only low space-time yields. If, on the other hand, the conventional fluidized bed process, which permits higher throughputs, is employed for reducing the iron oxide hydroxide which is a particularly suitable starting material for the production of ferromagnetic iron particles, substantial variations in the magnetic properties of the end product must be put up with because of the poor fluidized characteristics and the resulting channeling of the iron oxide hydroxide.

It is an object of the present invention to provide a process for the preparation of acicular ferromagnetic metal particles, consisting essentially of iron, in which the reduction of the iron oxide or, more particularly, the iron oxide hydroxide is carried out in such a way that the known intrinsic advantages of the fluidized bed process are utilized, while avoiding the known disadvantages, so that a uniform end product is obtained in a reproducible manner.

We have found that, surprisingly, this object is achieved by providing a stirrer in the fluidized bed furnace immediately above the fluidizing grid.

This simple measure has the effect that the material which is to be reduced and is in the fluidized bed is distributed uniformly, without the disadvantage of channeling, and that the properties, especially the magnetic properties, of the resulting ferrogmagnetic metal particles, consisting essentially of iron, show virtually no variation.

Figure 2:
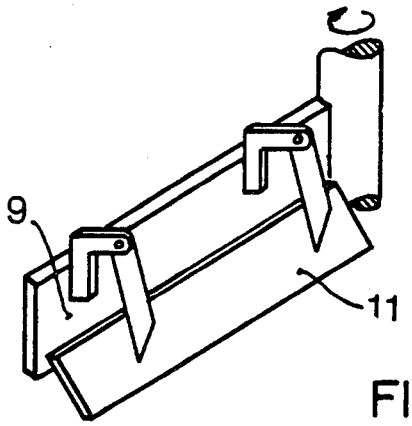

The process according to the invention is explained in more detail below with reference to the accompanying drawing, in which FIG. 1 shows the construction of a fluidized bed furnace for the process according to the invention and FIG. 2 shows a particularly advantageous embodiment.

A fluidized bed furnace suitable for the process according to the invention is constructed in a conventional manner. It consists, as is shown by way of example in FIG. 1, of a vertical tubular furnace 1 which usually widens out at the top. The fluidizing gas, in the present instance the reducing medium, is heated in the heat exchanger 3 and then blown into the furnace through the inlet 2, and is distributed uniformly over the entire cross-section of the tube by the fluidizing grid 4, which in most cases is a frit plate.

By means of this stream of gas, the material which is to be reduced, and is introduced through the feed point 5 is kept in a suspended state 6. The heating elements 7 serve to maintain the requisite reaction temperature. The gas outlet 8, with downstream filter means, is at the upper end of the furnace. The stirrer 9, which is the essential feature of the process according to the invention and is immediately above the fluidizing grid 4 has one or more stirrer arms and ensures uniform distribution of the fluidized product 6 in the fluidizing chamber. After completion of the reaction, ie. after reduction of the iron oxide particles to the metal particles, the latter are discharged from the fluidized bed furnace with the aid of the stirrer 9, via the outlet 10, which can alternatively be located centrally below the fluidizing grid.

Using the process according to the invention, acicular iron oxides and/or iron oxide hydroxides can be reduced to uniform metal particles. By avoiding the adverse phenomenon of channeling during fluidizing of the starting materials mentioned, uniform distribution of the material in the reaction zone, and of the temperature in the material is achieved. A further advantage of the process according to the invention is that caking on the reactor wall no longer occurs and hence this cause of an uncontrolled reaction is also suppressed. Another advantageous effect of the process according to the invention is that because of the effect exerted by the stirrer provided immediately above the fluidizing grid, the gas velocity in the fluidized bed can be reduced without causing inhomogeneous fluidization. This results in a reduction in the amount of dust discharged, so that fewer filters are required.

In a further embodiment of the process according to the invention it has proved particularly advantageous to attach, to at least one stirrer arm, a drag flap which bridges the gap between the stirrer arm and the fluidizing grid. The drag flap is so arranged that during the fluidizing operation it lifts away from the fluidizing grid, and only when the product is being discharged does the flap, under its own weight, scrape over the fluidizing grid. With this arrangement, the residual material, which is present between the stirrer arm and the fluidizing grid and could, when subsequent reductions are carried out in the fluidized bed furnace, give a less uniform product, is discharged in a simple manner. FIG. 2 shows an example of such a drag flap. The drag flap 11 is hingedly attached to the stirrer arm 9. If the outlet for the product from the fluidized bed furnace is located centrally, the end of the stirrer arm is concave in the direction of rotation of the stirrer. If, on the other hand, the outlet is at the side of the furnace, as is shown in FIG. 1, the stirrer arm is advantageously slightly convex.

Suitable starting materials for the novel process for the preparation of ferromagnetic metal particles consisting essentially of iron are all acicular iron oxides, which may be pure or modified with conventional foreign metal ions. They include the conventional modifications of iron(III) oxide hydroxides, which are in particular employed for the preparation of magnetic materials for magnetic recording media, as well as the acicular $\alpha$- and $\gamma$-iron(III) oxides and magnetite derived therefrom, and mixtures of these. The said materials can also be used in a form modified with foreign metal ions, usually cobalt, nickel or chromium. Materials which have proved particularly advantageous for the preparation of the metal particles are acicular goethite, lepidocrocite and mixtures of these, in each case with a mean particle length of from 0.1 to 2 $\mu$m, preferably from 0.2 to 1.2 $\mu$m, a length width ratio of from 5:1 to 40:1 and a specific surface area ($S_{N2}$), measured by the BET method, of from 25 to 80 $m^2$ per gram. The products obtained by heating—advantageously at from 250° to 700° C-the above iron(III) oxide hydroxides may also be employed.

For better retention of the particle shape, the iron oxides mentioned are subjected to a conventional shape-stabilizing treatment, for example as described in German Laid-Open Applications DOS 2,434,058, DOS 2,434,096, DOS 2,646,348, DOS 2,714,588 and DOS 2,743,298. This treatment is preferably carried out at the iron oxide hydroxide stage, before the particles are exposed to a heating or transformation process. The subsequent reduction of the oxidic product to the metal in a fluidized bed, by means of a gaseous reducing agent, usually hydrogen, is carried out at from 260° to 450° C., preferably from 300° to 420° C., over from 3 to 36 hours, usually employing not less than a 60-fold excess of hydrogen .

The acicular ferromagnetic metal particles, consisting essentially of iron, which are obtained by the process according to the invention still substantially have the original shape of the starting materials and are uniform in spite of having been subjected to the conversion reaction. Consequently, they have good magnetic properties, such as a high coercive force and, in particular, high remanence. The high hysteretic squareness ratio is an indication of a narrow field strength distribution due to the uniform shape of the particles.

Such metal particles are outstandingly suitable for use as magnetic materials for the preparation of magnetic recording media. Advantageously, however, these materials are passivated before being processed further. This passivation entails coating the metal particles with an oxide layer by controlled oxidation, so as to eliminate the pyrophoric character resulting from the large free surface area of the small particles. Usually, this passivation is effected by passing a mixture of air and nitrogen over the metal powder at a precisely maintained temperature preferably not exceeding 100° C. This treatment can also be carried out particularly successfully in the fluidized bed furnace employed for the process according to the invention.

The Examples which follow illustrate the present invention. The magnetic properties of the samples were measured with a vibrating sample magnetometer at a field strength of 160 kA/m. The coercive force $H_c$, measured in kA/m, was determined on the basis of a tamped density of the magnetic pigment of $\rho=1.6$ g/cm$^3$. The specific remanence ($M_{r/\rho}$) and the specific saturation magnetization ($M_{m/\rho}$) are each quoted in nTm$^3$/g.

EXAMPLE 1

The starting material $\alpha$-FeOOH, prepared by the method of German Published Application DAS 1,204,644 and treated with phosphoric acid and oxalic acid as described in German Laid-Open Application DOS 2,646,348, is reduced in a fluidized bed with stirrer, as shown in FIG. 1, at 350° C., by passage of a 64-fold excess of hydrogen in the course of 6 hours. The stirrer rotates at 28 rpm. The magnetic properties of the resulting iron particles are shown in Table 1.

COMPARATIVE EXPERIMENT 1

The procedure described in Example 1 is followed, but with the stirrer stationary in the fluidized bed furnace. The results are shown in Table 1.

EXAMPLE 2

The procedure described in Example 1 is followed, but at a reduction temperature of 330° C.

The results are shown in Table 1.

TABLE 1

| | Stirrer speed (rpm) | Degree of reduction % Fe | $H_c$ $\rho = 1.6$ (kA/m) | $M_m/\rho$ ($nTm^3/g$) | $M_r/\rho$ ($nTm^3/g$) | $^+M_r/M_m$ |
|---|---|---|---|---|---|---|
| Example 1 | 28 | 97.4 | 69.2 | 154 | 94 | 0.61 |
| Comparative Experiment 1 | 0 | 86 | 65.1 | 113 | 65 | 0.58 |
| Example 2 | 28 | 97 | 68.3 | 144 | 84 | 0.58 |

$^+M_r/M_m$ = relative remanence

EXAMPLE 3

The starting material γ-FeOOH, prepared as described in German Published Application DAS 1,061,760 and surface-treated as in Example 1, is heated for one hour at 600° C. in air and is then reduced in a fluidized bed furnace, as shown in FIG. 1, at 350° C. in the course of 4.5 hours (Sample a) or of 6 hours (Sample b); in each case the stirrer runs at 28 rpm. The magnetic properties of the resulting materials are shown in Table 2.

COMPARATIVE EXPERIMENT 2

The procedure described in Example 3 is followed, but with the stirrer stationary. The results are shown in Table 2.

TABLE 2

| | Stirrer speed (rpm) | Reduction time (h) | $M_m/\rho$ ($nTm^3/g$) | $M_r/\rho$ ($nTm^3/g$) | $M_r/M_m$ |
|---|---|---|---|---|---|
| Example 3a | 28 | 4.5 | 153 | 74 | 0.48 |
| Example 3b | 28 | 6 | 193 | 90 | 0.47 |
| Comparative Experiment 2a | 0 | 4.5 | 128 | 63 | 0.49 |
| Comparative Experiment 2b | 0 | 6 | 158 | 64 | 0.40 |

EXAMPLE 4

To permit better handling, the iron powder prepared as described in Example 2 was passivated in a fluidized bed furnace as shown in FIG. 1, at a temperature not exceeding 50° C., by means of a 1:15 air/nitrogen mixture. This changed the magnetic properties to the following values:

$H_c = 72.3$ kA/m
$M_{m/\rho} = 104$ $nTm^3/g$
$M_{r/\rho} = 70$ $nTm^3/g$
$M_r/M_m = 0.58$.

EXAMPLE 5

800 parts of the passivated iron particles prepared as described in Example 4 are mixed, in a cylindrical steel ball mill, of 6,000 parts by volume capacity and containing 900 parts of steel balls of diameter from 4 to 6 mm, with 456 parts of a 13% strength solution of a thermoplastic polyester-urethane obtained from adipic acid, butane-1,4-diol and 4,4'-diisocyanatodiphenylmethane in a solvent mixture of equal parts of tetrahydrofuran and dioxane, 296 parts of a 10% strength solution of a polyvinylformal binder, containing 82% of vinylformal units, 12% of vinyl acetate units and 6% of vinyl alcohol units, in the same solvent mixture, 20 parts of butyl stearate and a further 492 parts of the said solvent mixture, and the batch is dispersed for 4 days. Thereafter a further 456 parts of the stated polyester-urethane solution, 296 parts of the stated polyvinylformal solution, 271 parts of the solvent mixture and 2 parts of a commerical silicone oil are added, dispersing is continued for 24 hours, and the mixture is then filtered through a cellulose/asbestos fiber layer. The resulting magnetic dispersion is applied, on a conventional coating apparatus, to an 11.5 μm thick polyethylene terephthalate base film, passed through a magnetic orienting field, and then dried in the course of 2 minutes at 80°–100° C. Thereafter, the magnetic layer is calendered by passing it between heated polished rolls at 60°–80° C. The final magnetic layer is 3.5 μm thick. The coated film is slit into 3.8 mm wide tapes.

The electro-acoustic properties of these tapes are measured by a method based on DIN 45,512, using a tape speed of 4.75 cm/sec, an HF biassing current $I_{HF}$ of 23 mA and an equalization time constant of 70 μsec.

The Table below shows the maximum output levels at 333 $H_z$ ($A_T$) and at 10 kHz ($A_H$).

The tape obtained has the following data:

| Magnetic properties of tape 160 kA/m | | | | Electro-acoustic properties at 4.75 cm/sec $I_{HF}$ = 23 mA. Equalization time constant = 70 μsec Recording head gap width = 2.5 μm | |
|---|---|---|---|---|---|
| $H_c$ (kA/m) | $M_m$ (mT) | $M_r$ (mT) | Orientation ratio | $A_T$ relative to C 401 R in [db] | $A_H$ relative to C 401 R in [db] |
| 78.9 | 304 | 245 | 2.3 | +1 | +8.5 |

We claim:

1. A process for the preparation of acicular ferromagnetic metal particles, consisting essentially of iron, by reducing acicular iron oxides and/or iron oxide hydroxides, which are either pure or are modified with conventional foreign metal ions, by means of a gaseous reducing agent in a fluidized bed furnace having a fluidizing grid, said process including:

providing a stirrer having at least one arm in the fluidized bed furnace at a point immediately above said grid, and stirring the fluidized product at that location by means of said stirrer.

2. In an apparatus for the preparation of acicular ferromagnetic metal particles, consisting essentially of iron, by reducing acicular iron oxides and/or iron oxide hydroxides, which are either pure or are modified with conventional foreign metal ions, said apparatus comprising a fluidized bed furnace with means for introducing a gaseous reducing agent into said furnace, the improvement that a stirrer is provided in the fluidized bed furnace immediately above the fluidizing grid, said stirrer having at least one arm to which a drag flap is attached, said drag flap bridging the gap between the arm and the fluidizing grid.

3. In an apparatus for the preparation of acicular ferromagnetic metal particles the improvement as claimed in claim 2, wherein said drag flap is hingedly attached to said arm so as to lift away from the fluidizing grid during the fluidizing operation.

* * * * *